US005984154A

United States Patent [19]

Scicluna

[11] Patent Number: 5,984,154

[45] Date of Patent: Nov. 16, 1999

[54] WHEELAWAY BACKPACK

[75] Inventor: Paul Scicluna, Penndel, Pa.

[73] Assignee: Tumi, Inc., Middlesex, N.J.

[21] Appl. No.: 09/160,014

[22] Filed: Sep. 24, 1998

[51] Int. Cl.[6] ..... A45F 4/02

[52] U.S. Cl. ..... 224/153; 224/579; 224/627; 224/644; 224/653; 190/18 A

[58] Field of Search ..... 224/575, 576, 224/577, 153, 578–583, 627, 628, 633, 642, 644, 645, 650, 652, 653, 654, 655, 657; 190/18 A

[56] References Cited

U.S. PATENT DOCUMENTS

| | | | |
|---|---|---|---|
| D. 375,402 | 11/1996 | Yeh | 224/153 X |
| 4,066,195 | 1/1978 | Dickler . | |
| 4,368,835 | 1/1983 | Murphy . | |
| 4,524,482 | 6/1985 | Mueller . | |
| 4,961,522 | 10/1990 | Weber . | |
| 5,022,574 | 6/1991 | Cesari . | |
| 5,447,261 | 9/1995 | Mitomi et al. . | |
| 5,575,362 | 11/1996 | Franklin et al. | 190/18 A X |
| 5,749,503 | 5/1998 | Wulf et al. . | |
| 5,893,495 | 4/1999 | Godshaw et al. | 224/153 |

FOREIGN PATENT DOCUMENTS

| | | |
|---|---|---|
| 2 454 773 | 11/1980 | France . |
| 1 238 303 | 7/1971 | United Kingdom . |

*Primary Examiner*—Gregory M. Vidovich
*Attorney, Agent, or Firm*—Baker & Botts, L.L.P.

[57] ABSTRACT

The shoulder straps of a wheelaway backpack are stowed in a compartment between a main back wall panel and a secondary back wall panel of the container, which compartment also receives the towing handle support tubes. A wheel cover panel, the lower edge of which is stitched to the outside of the main back wall panel some distance above the lower back edge of the backpack, has zippers along the sides for attaching it to the secondary back wall panel and forming a compartment for convenient temporary storage of articles. When unzipped and folded down against the lower part of the main back wall panel, the wheel cover panel covers the rear aspects of the wheels so as to keep the clothing of a user carrying the backpack on his or her back from being soiled by dirt and moisture on the wheels.

10 Claims, 4 Drawing Sheets

WHEELAWAY BACKPACK

BACKGROUND OF THE INVENTION

Although luggage with wheels has been known and available in various forms for a relatively long time, wheeled luggage has become immensely popular within the past few years. One form of wheeled luggage is a wheelaway backpack, a characteristic feature of which is the inclusion of a pair of shoulder straps that permit the user to carry the luggage item on his or her back. There are several aspects of the design of wheelaway backpacks that require attention. First, it is necessary to provide for storage of the shoulder straps so that they are not exposed to catching on other objects when the backpack is handled as checked luggage on a plane or train or otherwise handled and stowed with other articles for transport. Second, the wall of the backpack that rests on the user's back should be padded or otherwise treated to make it comfortable to the user's back. Third, the wheels should be covered when the backpack is carried on the user's back so that his or her clothing is protected from being soiled by dirty or wet wheels. In that regard, the wheels usually protrude from the lower back corners of the pack such that segments are located behind the plane of the rear wall of the pack. The foregoing requirements for wheelaway backpacks have been met in various ways in previously known designs.

U.S. Pat. No. 5,749,503 (Wulf et al., 1998) describes and shows a wheelaway backpack that includes wheels on each end of the lower back edge of a main compartment or container and a towing handle that telescopes into and out of tubes that extend along the back wall panel of the main container. A second compartment is provided behind the towing handle tubes for stowing the shoulder straps. The second compartment extends the full height of the backpack and has a front panel that overlies the towing handle tubes, thus sandwiching the towing handle tubes between the back panel of the main compartment and the front panel of the second compartment. The upper portion of the back panel of the second compartment is connected by a zipper to the front panel along the sides and the top. When the upper part of the back panel is unzipped from the front panel, it folds down so as to serve as a protective flap for the exposed parts of the wheels. A tab with one element of a hook and loop cloth ("VELCRO") extends from the free edge of the flap and is attached to a patch of the other hook/loop cloth element that is secured to the bottom of the backpack to hold the back flap in place.

The full-height second compartment provides padding so that the towing handle tubes, which are sandwiched between the main and second compartments, do not dig into the user's back. The space between the main and second compartments is "dead space," serving only to contain the towing handle tubes and isolate them from the main compartment and the second compartment. The second compartment serves only for stowage of the shoulder straps, although it is possible to place articles in the second compartment with the straps. Articles placed in the second compartment are not, however, readily accessible to the user, inasmuch as the second compartment extends the full height and the user has to fish for them at the bottom of the backpack. Use of the second compartment for packing articles is also impractical because the upper part is opened when the straps are deployed and because articles placed in the lower part of the second compartment are likely to make the backpack uncomfortable when it is carried on the user's back.

SUMMARY OF THE INVENTION

One object of the present invention is to provide a wheelaway backpack in which the shoulder straps are stowed in a manner that makes good use of space that is "dead space" in previously known wheelaway backpacks. Another object is to provide a flap that covers the wheels when the backpack is configured to be carried on a user's back and that forms a compartment for temporarily stowing articles when the straps are stowed and the backpack is configured for being rolled or carried by a hand-carrying handle.

The foregoing and other objects are attained, in accordance with the present invention, by a wheelaway backpack that includes a substantially rigid bottom chassis, a pair of wheels mounted for rotation at the ends of the lower rear edge of the bottom chassis, and a pair of towing handle support tubes affixed to the bottom chassis and extending in parallel spaced-apart relation upwardly from adjacent the rear edge of the bottom chassis. The legs of a U-shaped towing handle are telescopically received in the support tubes. A container of a flexible material is attached to the bottom chassis and the towing handle support tubes, the container having a bottom wall, side walls, a top wall, a front wall, a main rear wall and a secondary rear wall. The secondary rear wall is attached to upper portions of the rear edges of the side walls and to the rear edge of the top wall and lies in front of the towing handle support tubes. The main rear wall is attached to lower portions of the rear edges of the side walls and to the rear edge of the bottom wall, lies behind the towing handle tubes, and has a flap adjacent its upper edge. The upper portion of the main rear wall and a lower portion of the secondary rear wall form a compartment that receives portions of the towing handle support tubes. Access to the compartment is facilitated by opening the top flap of the main rear wall. One end of each of a pair of shoulder straps is attached to the secondary rear wall of the container adjacent the upper edge thereof. The shoulder straps are stowed in the compartment between the support tubes when the shoulder straps are not in use.

A wheel cover panel of flexible material is attached at a lower edge thereof to the main rear wall of the container in spaced-apart relation from the lower rear edge of the bottom chassis and is releasably attached at least along the side edges thereof to the secondary rear wall. The wheel cover panel forms a compartment of the backpack when the side edges are attached to the secondary rear wall and serves as a protective cover over rear aspects of the wheels when the side edges are released from the secondary rear wall and the cover panel is turned down about its lower edge to reside face to face with the main rear wall.

The wheeled backpack of the present invention makes good use of the available space by providing for stowage of the shoulder straps in the compartment formed by the main back wall and secondary back wall of the container, which is dead space in previously known wheelaway backpacks. The shoulder straps, when stowed, are located between the towing handle support tubes. That aspect of the invention saves space and reduces the total volume of the backpack, all other things being equal. The flap that folds down to cover the-wheels has another highly useful purpose when its side edges are fastened to the secondary rear wall of the container—it provides a compartment for temporary stowing of articles, such as reading material, snacks, drinks, or the like, that the user may want to have available when the backpack is configured for towing or carrying by hand. The compartment is near the top of the backpack, which makes it readily accessible, and is at most about half and usually less than half of the height of the backpack so that articles placed in it can be easily retrieved.

In preferred embodiments of the present invention, releasable fasteners, such as hook and loop cloth fasteners ("VELCRO"), join the flap at the top of the main rear wall of the container to the secondary rear wall so as to close the upper portion of the compartment when the shoulder straps are stowed. The side edges of the wheel cover panel are attached to the secondary rear wall by zippers when the backpack is configured for towing. It is also possible to have the wheel cover panel zippered along the top as well as the sides. A releasable fastener connects the wheel cover panel to the container in the turned down position face to face with the main rear wall. For example, the releasable fastener may include a flexible fastening strip carrying one element of a fastener device. The fastening strip may be attached to the center portion of the upper edge of the wheel cover panel so that it can be tucked into the compartment formed when the side edges of the wheel cover panel are attached to the secondary rear wall and extends under the bottom wall of the container when the wheel cover panel is in the turned down position. A preferred fastener for the wheel cover panel is hook and loop cloth.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENTS

Figure 4:
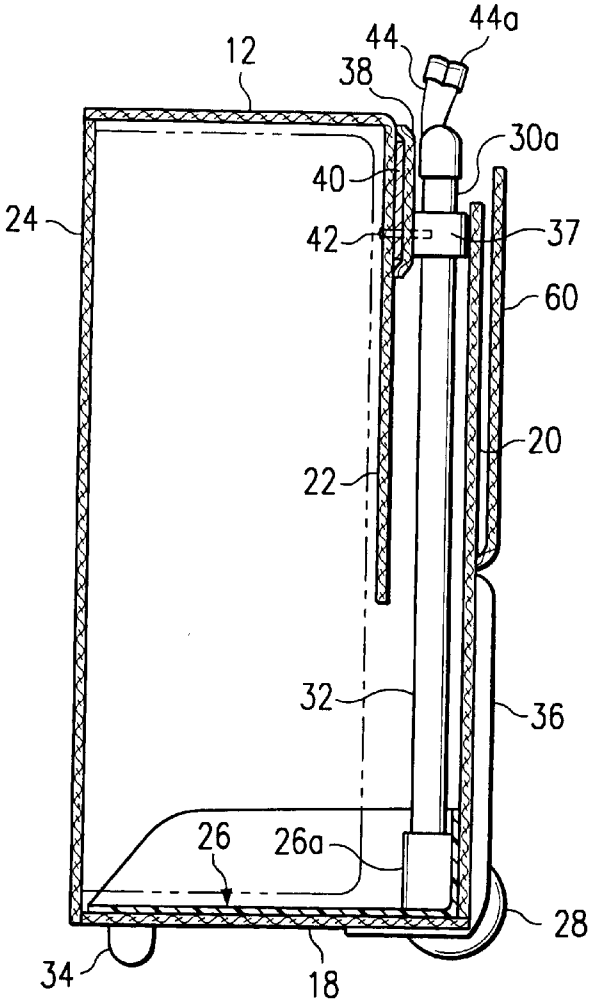
FIG. 4 is a side cross-sectional view of the first embodiment, taken laterally in front of the towing handle with respect to the rear side.

The primary component of the backpack is a container 10 made of panels of a durable flexible material, a woven fabric being preferred, which are joined by stitching. The container has a top wall 12, side walls 14 and 16, a bottom wall 18, a main rear wall 20, a secondary rear wall 22, and a front wall 24 (see FIG. 4). The lower edge of the front wall is joined by stitching to the front edge of the bottom wall 18 and is releasably joined to the front edges of the side walls and the front edge of the top wall by a zipper (not shown). When the front wall is unzipped, the container is completely open at the front for packing or unpacking articles. The front wall can have an external zippered compartment, if desired. The container may also have a top flap that has one or more zippered compartments, overlies the top wall and the upper part of the front wall, and is releasably connected to the front wall by straps and buckles. A compartment on the part of the top flap that overlies the top wall of the container may contain one part of a buckle, to which an add-a-bag strap and hook can be connected to the backpack for piggybacking articles on the backpack.

Figure 5:
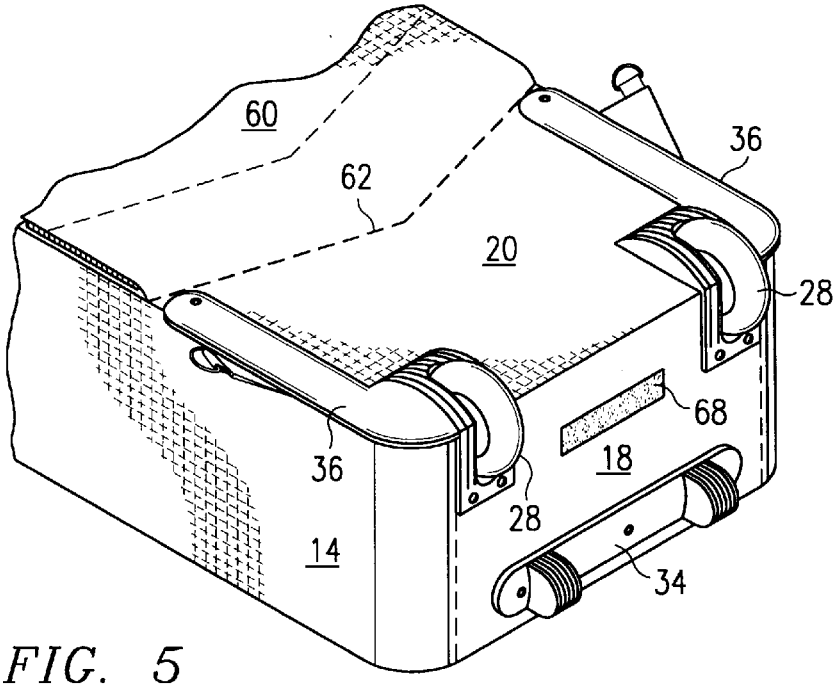
FIG. 5 is a partial three-quarter bottom pictorial view of the first embodiment.

The backpack is arranged so that it can be rolled along a surface by supporting the bottom portion of the container 10 on a bottom chassis 26 (see FIG. 4), by providing a wheel 28 near each side of the rear edge of the bottom chassis, and by providing a towing handle 30. The specific construction of the bottom chassis 26 is not part of the present invention, and suitable designs for chassis for wheeled luggage are well-known. Therefore, no detailed description of the construction of the bottom chassis is required or given, and the bottom chassis is shown generally schematically in the drawings. The functions of the bottom chassis are to render the bottom wall of the container (and, preferably, lower parts of the sides and back) essentially rigid, carry the wheels 28, and support a pair of tubes 32 that receive the legs 30*a* of the towing handle 30 in telescoping relation. The legs 30*a* slide with the tubes between a retracted position and an extended position. The towing handle may include a latch mechanism for retaining it in each of those positions. The backpack also has a foot member 34 on the outside of the bottom of the container near the front edge (see FIG. 5), which permits the backpack to stand upright on a surface. Surrounds for the wheels and skid rails that allow the backpack to be skidded up or down stairs and curbs are provided by L-shaped (in lateral profile) skid pieces 36, the lower portions of which are fastened to the bottom chassis 26. The upper ends of the skid pieces are fastened to the main back wall 20 of the container such that the lower part of the back wall is stiffened.

The towing handle support tubes 32 extend up from sockets 26*a* on the bottom chassis and pass behind the secondary back wall 22 and in front of the main back wall 20. The secondary back wall 22 is a panel that is joined to the rear edge of the top wall 12 and the upper portions of the back edges of the side walls 14 and 16 and extends only partway along the back of the container (see FIG. 4). It is possible, however, for the secondary back wall to extend almost to the bottom of the container. For good appearance and function and for ease of assembly of the backpack, the interior of the container receives a liner that is coextensive with all walls except the front, is stitched to the front edge of the bottom wall 18, and is zippered to the front edges of the side and top walls. The liner isolates articles packed in the container from the bottom chassis and components (e.g., the tubes 32) below the lower edge of the secondary back wall 22. When unzipped and pulled out, the chassis, tubes, and other components are accessible, which facilitates assembly.

The upper ends of the tubes 32 receive a cap/crosspiece 37. A pocket formed by a fabric panel 38 on the upper back part of the secondary back wall 22 of the container receives a stiffener plate 40. The wall 22, the stiffener plate 40, and the panel 38 are fastened as a sandwich to the cap/crosspiece 37 by fasteners 42. Thus, the upper part of the back of the container is stiffened and the back of the container is supported by the tubes 32 in a fixed position relative to the bottom. A carrying handle 44 of webbing having a tubular leather grip 44*a* is stitched to the panel 38.

Figure 2:
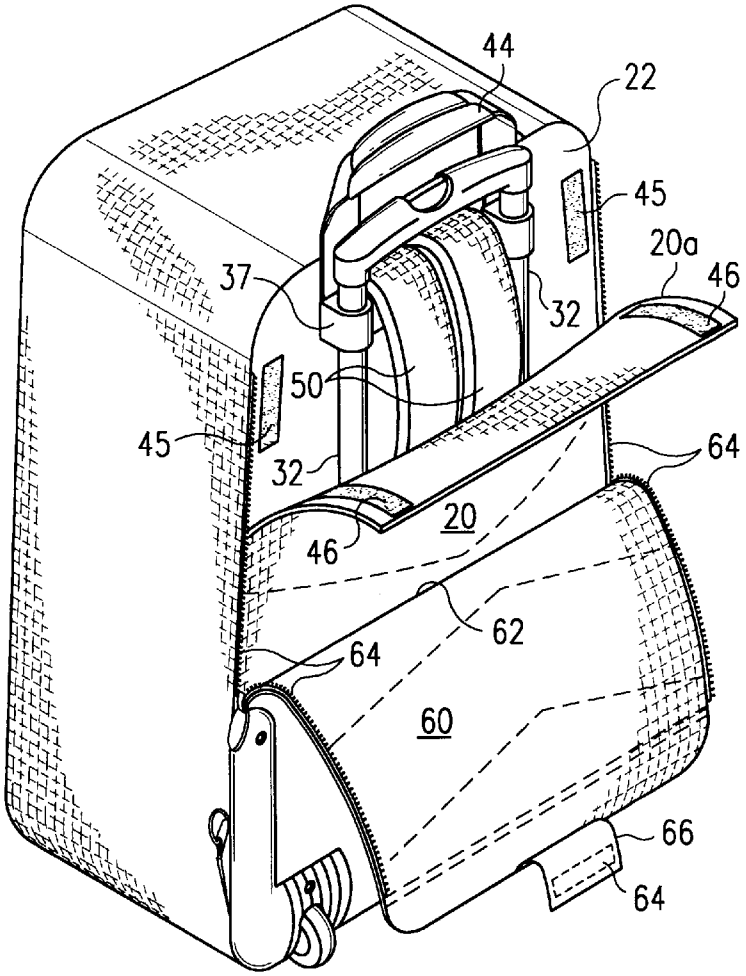
FIG. 2 is a three-quarter rear pictorial view of the first embodiment, which shows features of the backpack that are associated with converting it to a backpack configuration in a state of partial transformation.
Figure 1:
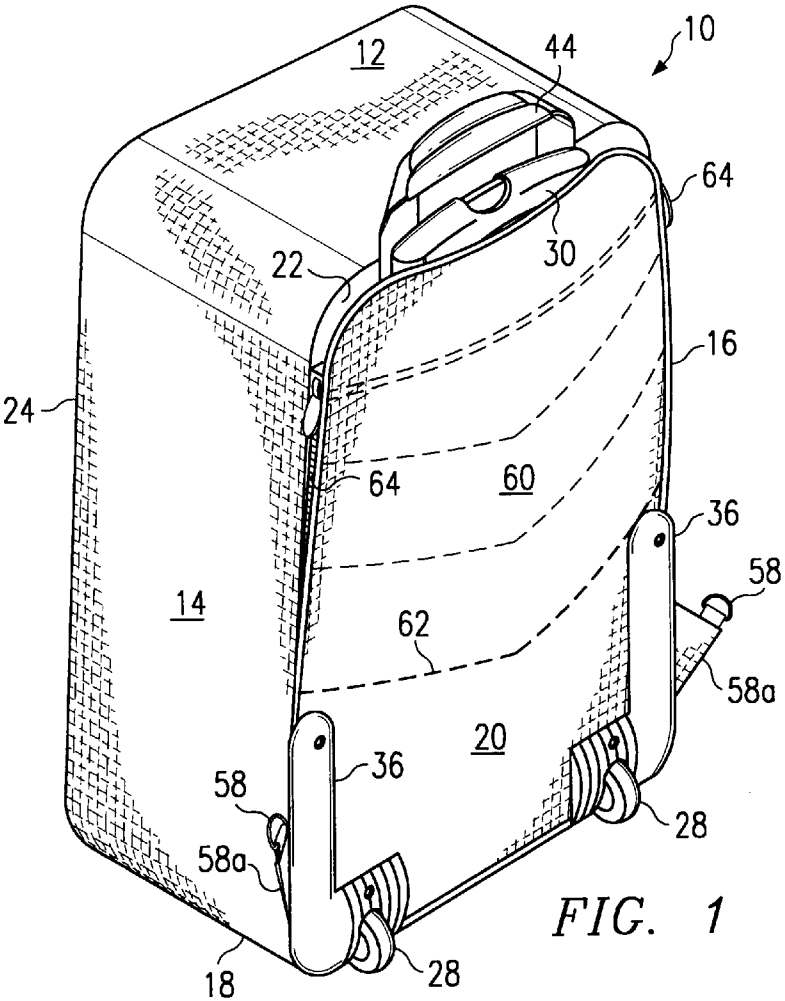
FIG. 1 is a three-quarter rear pictorial view of a first embodiment, which shows the backpack configured for towing or carrying by hand.

The main back wall 20 of the container is joined to the back edge of the bottom wall 18 and over the major part of the height of the container to the backs edges of the side walls 14 and 16. The upper parts of the side edges and the upper edge of the back wall 20 are free of permanent attachments, thus forming a flap 20*a* (see FIG. 2). Hook and loop cloth patches 45 affixed to the sides of the secondary back wall 22 and the mating patches 46 affixed to the flap provide for securing the flap 20*a* to the wall 22.

Figure 3:
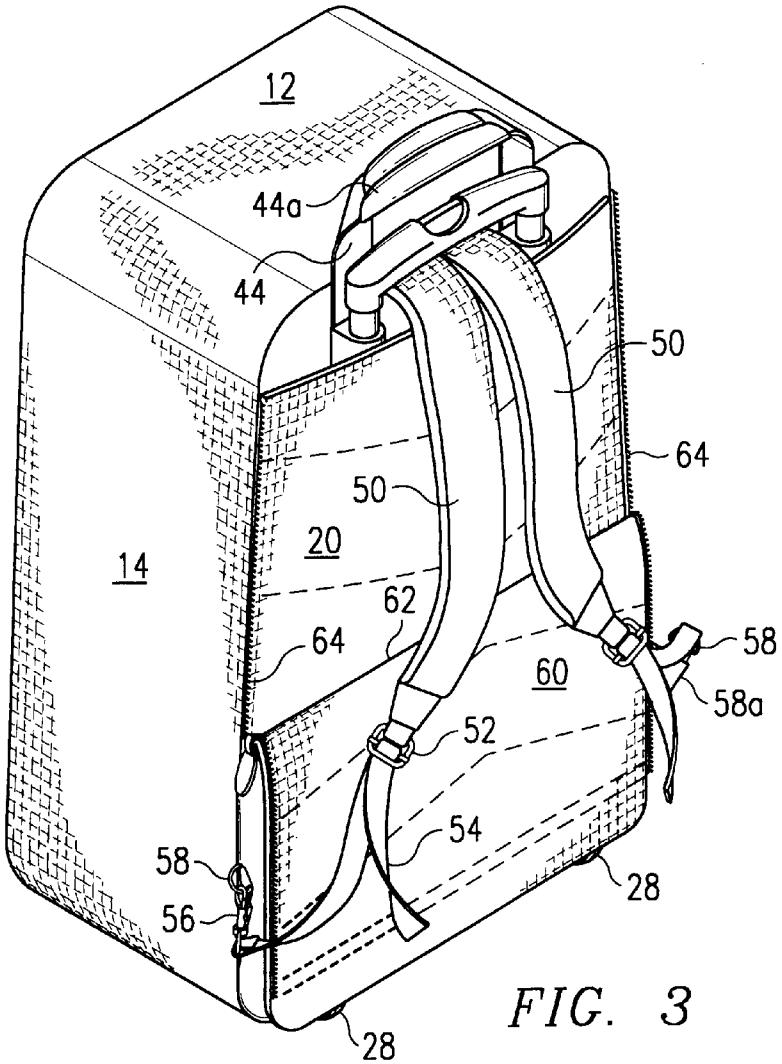
FIG. 3 is a three-quarter rear pictorial view of a first embodiment, which shows the backpack configuration.

The upper ends of a pair of padded shoulder straps 50 are stitched side by side to the panel 38 and the wall 22 at a location between the tubes 32 and adjacent the upper edge of the cap/crosspiece 37. The lower end of each shoulder strap 50 is attached by an adjustable cinch-type buckle 52 to a webbing 54, the lower end of which is fastened to the D-ring portion of a swivel/capture J-hook 56. When the backpack is configured for carrying on a user's back, the J-hooks 56 are connected to D-rings 58 that are fastened to fabric tabs 58*a* affixed to the sides of the back of the container (see FIG. 3). When the backpack is configured for towing, for carrying by hand using the handle 44, and for handling and transport as checked baggage, the J-hooks are disconnected, and the straps 50 and webbing 54 are stowed in the compartment formed by the space between the back wall 20 and the secondary back wall 22 of the container. The straps fit between the tubes 32 and occupy what would otherwise be dead space between the tubes. Stuffing the straps into the compartment is facilitated by releasing the hook/loop fasteners 45/46 between the flap 20*a* and the wall 22 (see FIG. 2).

Figure 6:
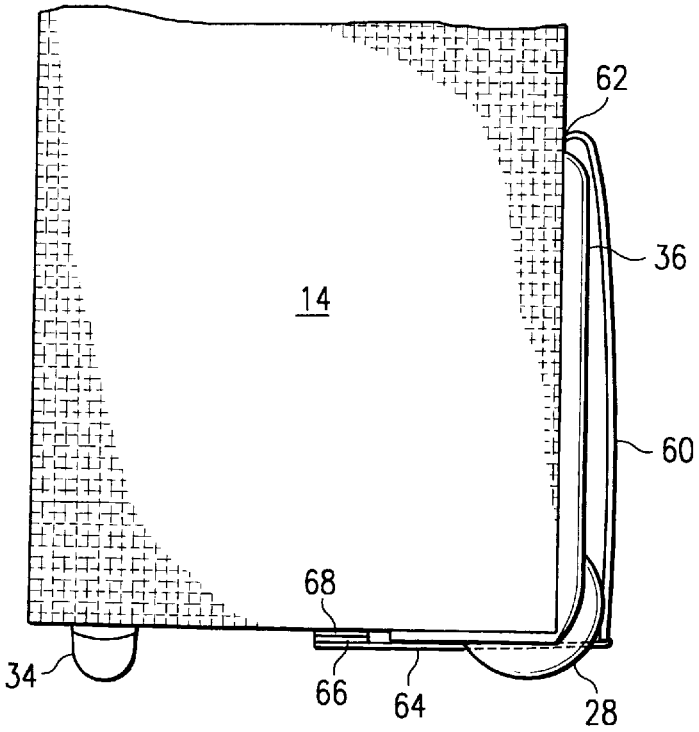
FIG. 6 is a partial side elevational view of the first embodiment, showing the wheel cover flap in the position in which it covers the rear aspects of the wheels.

When the backpack is carried on a user's back, a wheel cover flap 60, which is stitched along one edge by stitching 62 to the back wall 20 of the container, overlies the rear aspects of the wheels 28 (see FIG. 6) and prevents the clothing of the user from being soiled by moisture and dirt on the wheels. The cover flap 60 is secured in place by joining a hook/loop patch 64 on a fabric tab 66 that is stitched to the free edge of the flap 60 to a hook/loop patch 68 on the bottom of the container (see FIG. 5). The cover flap 60 and the main back wall panel 20 of the container are padded so as to make the backpack comfortable when carried on the user's back. Padding can be omitted from the lower part of the main back wall panel 20 below the stitch line 62, if desired. It is also possible to omit padding from the wheel cover flap 60, if the main back wall panel 20 is padded over its full height.

In addition to serving as a protective cover over the wheels 28, the wheel cover flap 60 forms with the upper part of the main back panel 20 an envelope or compartment. To that end, the flap 60 is connected by zippers 64 along each side edge to the upper part of the secondary back wall 22. The compartment or envelope is open at the top and is located along the top part of the backpack, having a height of around one-half or less than the full height of the backpack. Therefore, the envelope is convenient to use, inasmuch as articles can readily be retrieved. The user can put reading material, snacks, drinks, and other items that he or she may want to have at hand, such as while waiting to board a plane or train or towing the backpack, into the envelope.

Figure 7:
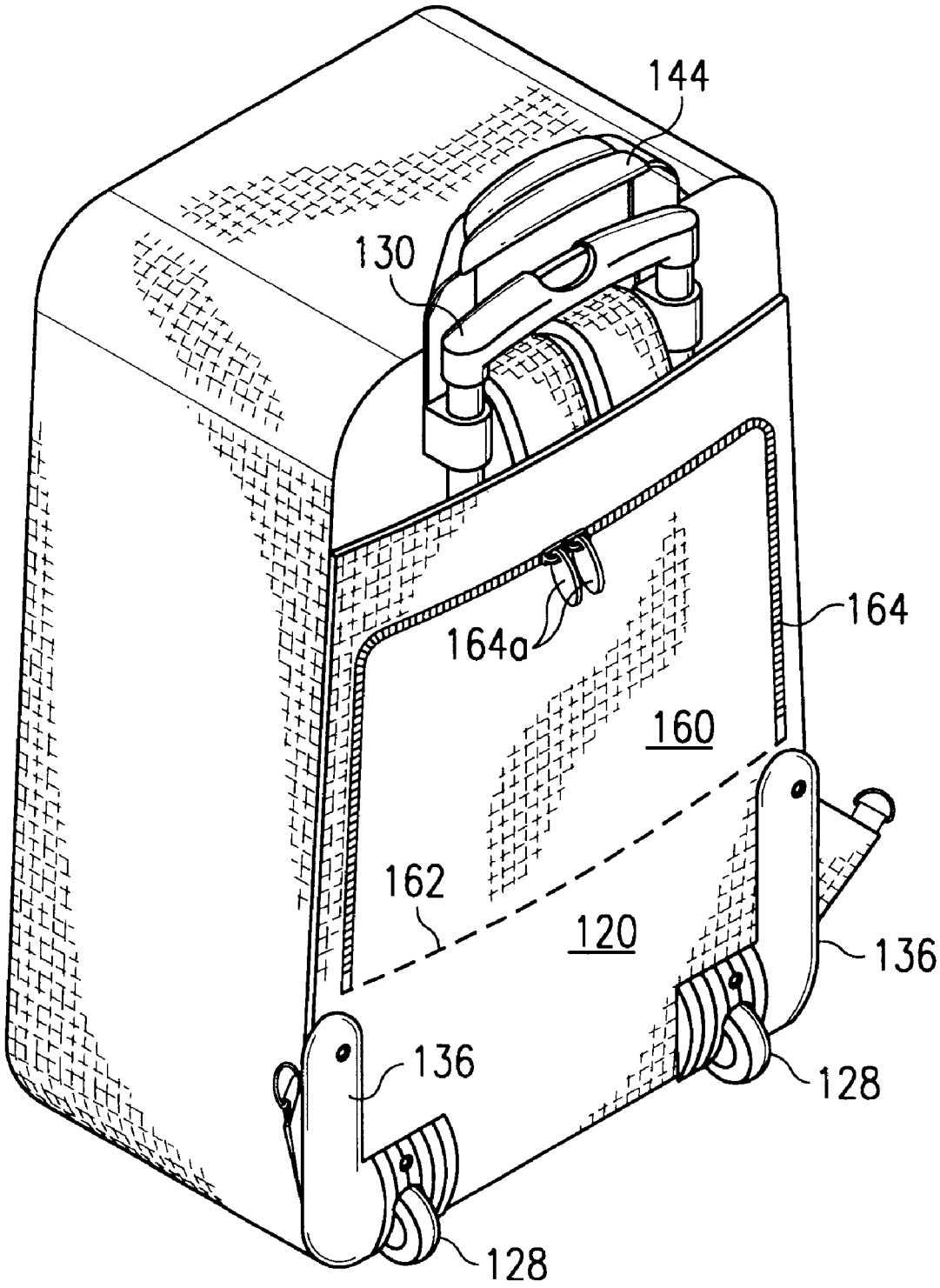
FIG. 7 is a three-quarter rear pictorial view of a second embodiment, which involves modifications of the skid rails and the wheel cover flap.

The backpack of FIGS. 1 to 6 has relatively tall skid rails 36, which requires that the wheel cover flap 60 be attached relatively high up on the main back wall panel 20 such that the upper edge when the flap is zippered up (FIG. 1) lies above the top of the main back wall panel 20. FIG. 7 shows a second embodiment, which differs from the first embodiment only in that the skid rails 136 are relatively short. (The reference numerals used for FIGS. 1 to 6, but increased by 100, are applied to FIG. 7). The lower position of the upper ends of the skid rails permits the lower edge of the wheel cover flap 160 (stitch line 162) to be lower down on the back and the height of the flap to be reduced. While the top edge of the flap 160 can be left free of attachment to the main back wall panel 120, the zipper can be provided along the side and the top, thus permitting the compartment formed by the cover panel to be fully closed. If a zipper with two sliders 164*a* is provided, as shown, the user is given the option of fully closing the compartment formed by the flap 160 or leaving it partly or fully open at the top. A compartment that can be fully closed is more secure than one that is open at the top. A closed compartment can be used for tickets, passports, wallets, and other articles that the user will want to have at hand but in a secure environment.

I claim:

1. A wheelaway backpack comprising a substantially rigid bottom chassis;

a pair of wheels mounted for rotation at the ends of a bottom rear edge of the bottom chassis;

a pair of towing handle support tubes affixed to the bottom chassis and extending upwardly in parallel spaced-apart relation adjacent the rear edge of the bottom chassis;

a U-shaped towing handle having a pair of legs, one of which is received telescopically in one of the support tubes and the other of which is received in the other support tube;

a container of a flexible material attached to the bottom chassis and having a bottom wall, side walls, a top wall, a front wall, a main rear wall and a secondary rear wall, the secondary rear wall being attached to upper portions of the rear edges of the side walls and to the rear edge of the top wall, the main rear wall being attached to lower portions of the rear edges of the side walls and to the rear edge of the bottom wall and having a flap adjacent its upper edge joinable with the secondary rear wall, and an upper portion of the main rear wall and a lower portion of the secondary rear wall forming a compartment that receives portions of the towing handle support tubes, access to the compartment being facilitated by opening the flap;

a pair of shoulder straps, each of which is attached at one end to the secondary rear wall of the container adjacent the upper edge thereof, the shoulder straps being stowed in the compartment and between the support tubes when the shoulder straps are not in use; and a wheel cover panel of flexible material attached at a lower edge thereof to the main rear wall of the container in spaced-apart relation from the bottom rear edge of the bottom chassis and releasably attached along side edges thereof to the secondary rear wall, the wheel cover panel forming a rear envelope of the backpack when the side edges are attached to the secondary rear wall and forming a protective cover over rear aspects of the wheels when the side edges thereof are released from the secondary rear wall and the cover panel is turned down about its lower edge to reside face to face with the main rear wall and cover the rear aspects of said wheels.

2. A wheelaway backpack according to claim 1 and further comprising releasable fasteners joining the flap of the main rear wall to the secondary rear wall so as to close the upper portion of the compartment when the shoulder straps are stowed.

3. A wheelaway backpack according to claim 2 wherein the releasable fasteners are hook and loop cloth fasteners.

4. A wheelaway backpack according to claim 1 wherein the side edges of the wheel cover panel are attached to the secondary rear wall by zippers.

5. A wheelaway backpack according to claim 1 and further comprising a releasable fastener for fastening the wheel cover panel to the container in the turned down position face to face with the main rear wall.

6. A wheelaway backpack according to claim 5 wherein the releasable fastener includes a flexible fastening strip carrying one element of a fastener device.

7. A wheelaway backpack according to claim wherein the fastening strip is attached to the center portion of the upper edge of the wheel cover panel so that it is tuckable into the envelope when the side edges of the wheel cover panel are attached to the secondary rear wall and extends under the bottom wall of the container when the wheel cover panel is in the turned down position.

8. A wheelaway backpack according to claim 5 wherein the fastener device is hook and loop cloth.

9. A wheelaway backpack according to claim 1 wherein the main rear wall of the container is padded.

10. A wheelaway backpack according to claim 1 wherein the wheel cover panel is padded.

* * * * *